US007063362B1

(12) United States Patent
Liroff

(10) Patent No.: US 7,063,362 B1
(45) Date of Patent: Jun. 20, 2006

(54) SEAL ASSEMBLY FOR A CARGO CONTAINER

(76) Inventor: Jeffrey Howard Liroff, 11350 NW. 36th Ter., Miami, FL (US) 33178

( * ) Notice: Subject to any disclaimer, the term of this patent is extended or adjusted under 35 U.S.C. 154(b) by 0 days.

(21) Appl. No.: 10/303,676

(22) Filed: Nov. 25, 2002

(51) Int. Cl.
*B65D 27/30* (2006.01)

(52) U.S. Cl. ..... 292/315; 292/307 R; 292/307 B; 292/318; 292/319; 292/320; 292/321; 292/323; 292/324; 292/326; 24/115 H; 24/129 R

(58) Field of Classification Search ..... 292/315, 292/307 R, 307 B, 318–321, 323, 324, 326; 24/115 H, 129 R, 129 A, 130, 115 G, 115 K, 24/136 R
See application file for complete search history.

(56) References Cited

U.S. PATENT DOCUMENTS

| | | | | | |
|---|---|---|---|---|---|
| 268,407 | A | * | 12/1882 | Hughes | 606/203 |
| 515,747 | A | * | 3/1894 | Carr | 292/320 |
| 909,525 | A | * | 1/1909 | Benton | 292/259 R |
| 1,034,741 | A | * | 8/1912 | Smith | 24/129 R |
| 1,365,477 | A | * | 1/1921 | Salvadore et al. | 292/307 A |
| 1,393,022 | A | * | 10/1921 | Hughes | 70/200 |
| 1,518,523 | A | * | 12/1924 | Kubik | 24/136 A |
| 1,764,380 | A | * | 6/1930 | Allen | 403/213 |
| 2,495,860 | A | * | 1/1950 | Miller | 292/258 |
| 2,556,900 | A | * | 6/1951 | Buschhorn | 70/230 |
| 2,597,583 | A | * | 5/1952 | Holmsten | 70/89 |
| 3,238,585 | A | * | 3/1966 | Froyd | 24/129 B |
| 3,328,064 | A | * | 6/1967 | Simon | 292/288 |
| 3,698,042 | A | * | 10/1972 | Hirschhorn | 24/16 R |
| 4,389,862 | A | * | 6/1983 | Hastings | 70/2 |
| 4,564,230 | A | * | 1/1986 | Haist | 292/218 |
| 4,681,355 | A | * | 7/1987 | Brammall et al. | 292/323 |
| 5,020,192 | A | * | 6/1991 | Gerlach | 24/136 R |
| 5,165,743 | A | * | 11/1992 | Zock | 292/288 |
| 5,339,498 | A | * | 8/1994 | Parsons | 24/129 R |
| 5,511,290 | A | * | 4/1996 | Perry et al. | 24/115 H |
| 6,000,736 | A | * | 12/1999 | Leon et al. | 292/326 |
| 6,113,163 | A | * | 9/2000 | Liroff | 292/307 R |
| 6,131,969 | A | * | 10/2000 | Natkins | 292/323 |
| 6,161,314 | A | * | 12/2000 | Kamrin | 36/112 |
| 6,591,641 | B1 | * | 7/2003 | Cann | 70/14 |
| 6,751,829 | B1 | * | 6/2004 | Bergstrom | 24/115 H |
| 6,839,942 | B1 | * | 1/2005 | Spearing | 24/115 R |

FOREIGN PATENT DOCUMENTS

| | | | |
|---|---|---|---|
| DE | 338136 | * | 6/1921 |

* cited by examiner

*Primary Examiner*—Brian E. Glessner
*Assistant Examiner*—Carlos Lugo
(74) *Attorney, Agent, or Firm*—Malloy & Malloy, P.A.

(57) ABSTRACT

A cargo seal assembly structured to maintain one or more doors on a cargo container in a closed and latched position comprising an elongated flexible material segment having a distal end, a proximal end and an intermediate portion extending therebetween. The flexible material segment is disposed and structured to extend in surrounding relation to the lock rods an concurrently into sealing engagement with the latch assembly. A lock body is attached to the flexible material segment at a location which prevents removal of the material segment from its operative position. As such unauthorized access to the interior of the cargo container can only be accomplished by destructive separation of the flexible material segment at two separate, spaced apart locations along its length. A single identifying indicia is disposed on the flexible material segment or an operative component associated therewith.

9 Claims, 5 Drawing Sheets

SEAL ASSEMBLY FOR A CARGO CONTAINER

BACKGROUND OF THE INVENTION

1. Field of the Invention

This invention is directed to an improved cargo seal assembly structured for use on a cargo container in order to maintain one or more doors associated therewith in a securely locked and sealed orientation. Moreover, a door of the cargo container is prevented from being opened without destructively removing, in at least two separate locations, an elongated flexible material segment, thereby providing clear evidence of tampering as well as indicating when tampering has occurred.

2. Description of the Related Art

Large cargo containers, such as those that are detachable or are formed as part of trailers, are the most commonly used means of transporting large volumes of varying types of cargo from location to location around the world. A primary advantage to their use is that the large containers can store large quantities of goods and can be effectively transported on boats, trains, and/or trucks in order to expeditiously arrive at their eventual destination. The detachability and adaptability of the containers are of particular importance because they will often change hands from one carrier to another carrier, such as from a train to a truck or from a trucking company to a steamship line, during the various legs of a transport route.

Naturally, due to the great volume and often valuable nature of the cargos being transported in the large containers, security is an important consideration when dealing with cargo transportation. Unfortunately, however, one of the most prevalent security concerns, in addition to the third party hijackers or thieves who do not generally care if they leave signs of a break in, involves internal theft, which is not obviously detectable. For example, it is sometimes an all too common occurrence that during transit, an individual placed in custody of the container, such as a truck driver in charge of transporting the cargo from point to point, is behind a robbery. Such an individual is naturally very familiar with the nature of the cargo on board, and can easily arrange for a safe rendezvous for the removal of all or part of the cargo contained within the large container. Unlikely as it may seem, in these instances, it is often the security measures and/or locks which are normally employed that serve as the biggest allies to the thieves.

A conventional, single-use, single end seal is the common article used to secure the door handle/latch in a door closing orientation. Moreover, this is the primary seal, and more likely the only seal that is looked at by shipping personnel assigned to verify the integrity of a shipment during transit. Unfortunately, thieves have still found ways to unlatch the doors without actually breaking the seal. Specifically, the joint between the actuation handle and the lock rod on most conventional containers generally incorporates a single bolt or rivet securing both elements to one another. As a result, a thief can merely cut or drill-out and remove that bolt or rivet to permit the independent turning of the lock rod while the actuation handle remains in place. The container is thereby opened without having to move the actuation handle or break the seal. Once the cargo has been removed and the door is re-closed, a replacement bolt is merely inserted to connect the actuation handle with the lock rod, and can be painted over if necessary to preserve the original appearance. As a result, the conventional type identifying seal has never been removed and no evidence of tampering is available as the cargo changes hands from one carrier to another. Accordingly, when the specific carrier involved in the theft arrives at a next leg of the transport, the container looks normal and intact, and the responsibility is passed on to the next transport carrier. Naturally, when the theft is ultimately discovered, blame passes from carrier to carrier with no concrete resolution as to the true thieves or the actual stage of transport during which the theft occurred. Moreover, as no positive blame can be put on any particular carrier, it is often the owner of the cargo who must take the loss and must fight their insurance company for some recovery.

Despite the numerous techniques thieves have found to defeat existing systems, and because of the high volume of cargo being transported on a daily basis, and the cost of more extensive security measures, most carriers still utilize the above-described securing methods to seal the cargo doors. Such carriers accept a certain percentage of losses to theft as an expense of doing business given the lack of a viable alternative. Accordingly, it would be highly beneficial to provide a cargo container seal and door lock which can defeat or at least significantly hinder the "inside job" theft in a cost effective and easy to implement fashion. Such an improved seal should be structured to resist opening of the doors without its removal, and should be difficult to replace without providing substantially clear and noticeable evidence of tampering, thereby allowing the identification of a theft by a transport company when they take on the cargo.

For these reasons, some carriers have turned to utilizing single use locking brackets which employ common single use, single end seals which bear a particular, recorded serial number thereon, if added security is desired. Accordingly, when the cargo container changes hands from one carrier to another both the bracket seal and the primary seal are supposed to be inspected and the numerals on the both seals are recorded to ensure that they match the shipping records. Still, however, while such techniques are more effective than the security measures which had previously been available, clever thieves have quickly found ways around those procedures as well.

Specifically, because a thief that performs such an "inside job" is typically associated with the normal shipping procedures, they are typically aware that in most circumstances, transfer of custody between carriers is only accompanied by an inspection of the primary cargo seal at the door latch, and a comparison of its identification number with the one depicted on the shipping manifest. Accordingly, a thief is typically able to merely cut off the bracket, removing it completely from the container and discarding the bracket seal. In particular, because a subsequent shipping agent is not aware of the condition in which a prior shipping agent received a cargo container, despite the fact that the bracket's serial number may have been clearly indicated on the manifest, the lack of the bracket is not usually recognized. This is especially the case if the primary cargo seal identification number is correct as a vast majority of shipments still arrive without any secondary sealing.

As such, it would be beneficial to provide an improved cargo seal that is structured to require the actual removal or tampering with the primary cargo seal in order to access the container. Such a seal, which prior to the present invention has not been provided, should be structured to be permanently and noticeably damaged or tampered with if the container is accessed, and should be difficult to duplicate easily and effectively. Accordingly, even a cursory review by a shipping agent of the primary seal serial number will necessarily reveal that tampering has occurred.

SUMMARY OF THE INVENTION

The present invention is directed to an improved cargo seal assembly structured to be used in combination with a cargo container of the type well known in the transportation industry. More specifically, a conventional cargo container usually includes two doors each of which has a locking rod connected to an exterior portion thereof. The locking rods are disposed in spaced but parallel relation to one another and are vertically oriented to extend along at least a majority of the length of their respective doors. The locking rods may be selectively positioned into a locked or an unlocked position thereby preventing or facilitating the opening of the respective doors and determining access to the interior of the cargo container and the cargo therein. Further, each of the locking rods includes a latch handle extending outwardly therefrom and selectively positionable into cooperative relation with a latch assembly. Sealing of the latch assembly maintains the latch handle in a fixed position while the respective locking rods associated therewith are maintained in their locked position. Access to the interior of the cargo container by opening the one or more doors is thereby prevented.

The cargo seal assembly of the present invention is structured to be connected to both of the locking rods and at least one latch assembly associated with one of the locking rods. As will be explained in greater detail hereinafter, access to the interior of the cargo container would necessitate destruction and removal of the cargo seal assembly in at least two different locations. This would provide clear evidence of tampering upon inspection of the subject cargo seal assembly as well as facilitating the determination of when such tampering or attempted unauthorized entry had occurred.

More specifically, the cargo seal assembly of the present invention comprises an elongated, flexible material segment of sufficient length to be disposed in surrounding relation to both of the locking rods as well as being connected to the latch assembly in a manner which restricts opening thereof. The flexible segment may preferably be formed of a high strength metal or other material which resists cutting, severing or other types of destructive separation along its length. By way of example, the material could be of sufficient strength to require the use of large bolt or cable cutters or an acetylene torch to cause a separation of the flexible material segment at a plurality of locations along its length. However, alternative embodiments of the present invention may include the flexible material segment being formed of a material of lesser strength, such as plastic. Obviously it would be easier to separate a lesser strength material segment along its length. Therefore economic factors may justify a plastic or like material being utilized, such as when shipping an empty container, wherein unauthorized access to the interior thereof does not result in loss or damage of cargo. In addition, the importance of securely locking and sealing an empty container is emphasized in order to reduce or eliminate the possibility of smuggled cargo being transported therein. By way of example, if an empty container is left closed and unsealed, or if a conventional sealing device is used therewith, access to the interior of the container is readily obtainable. Accordingly, the unauthorized shipping of various types of cargo, including aliens or weapons of mass destruction, by unscrupulous individuals could easily occur.

Regardless of the material being used, the elongated flexible material segment includes a proximal end and a distal end as well as an intermediate portion extending therebetween. The distal and proximal ends, as well as the intermediate portion, absent any enlarged seal structure and/or lock body being secured thereto, have sufficiently small transverse dimensions to fit within and pass through a seal aperture associated with a conventional latch assembly, as described above. However, when the flexible material member is in its intended sealing and locking position, the proximal end of the flexible material segment includes a seal element secured thereto. The seal element has an overall enlarged configuration which is sufficiently greater than the seal aperture of the latch assembly. Accordingly, the seal element due to its enlarged dimension and overall structure is prevented from passing through the seal aperture of the latch assembly. Therefore, the connection of a lock body and the primary, enlarged seal element to the flexible material segment, in their operative positions, prevents the removal of the flexible material segment from its sealing engagement with the latch structure without destructively separating it at a location substantially adjacent the latch structure.

As described in greater detail hereinafter, the flexible material segment may be operatively positioned on the cargo container with the primary, enlarged seal element being first attached or unattached. In positioning the flexible material segment in its operative, locked position relative to the one or more doors of the cargo carrier when the seal element is already attached, the distal end is passed through the seal aperture of the latch assembly, as set forth above. A pulling force is exerted on the distal end and/or the intermediate portion of the flexible material segment subsequent to passing through the seal aperture. The intermediate portion is then positioned in surrounding relation to both of the lock rods until the intermediate portion is in a "wrapped orientation", at which time a lock body is secured to the intermediate portion so as to maintain it in the wrapped orientation. The wrapped orientation may be more specifically defined by a tightly surrounding, wrapped engagement of the intermediate portion of the flexible material segment concurrently about both of the lock rods. The enlarged seal element will thereby be pulled into a confronting location which may abut the latch assembly in contiguous or adjacent relation to the seal aperture formed therein.

Alternatively, the flexible material segment may be attached in its locking and sealing position on the cargo container by first disposing the intermediate portion in the wrapped orientation about the lock rods. Once so positioned, a lock body will be secured to the intermediate portion so as to maintain it in the wrapped orientation. Thereafter, one of the free ends, such as the proximal end, is passed through the seal aperture in the latch assembly of the cargo container and the primary seal element is secured thereto.

As set forth above, when the intermediate portion of the flexible material segment is disposed in its tightly surrounding, wrapped orientation, a lock body is secured to adjacently oriented portions of the flexible material segments in a location exterior of the lock rods. Moreover in a preferred embodiment of the present invention the lock body may include structural features which permits passage of one end of the flexible material segment there through in only a single direction. Removal of the flexible material segment from the lock body by the passage thereof in the opposite direction is prevented. The attachment of the lock body to the adjacent portions of the intermediate portion of the flexible material segment thereby serves to maintain the intermediate portion in the aforementioned wrapped orientation. In such a position, the lock body is disposed in spaced relation to the latch assembly as well as the seal element positioned adjacent thereto. The proximal end of the flexible material segment extends outwardly in spaced relation to the lock body and, dependent upon the overall length of the flexible material segment, may be disposed in any of a variety of out of the way locations.

Therefore, any attempt to defeat the improved cargo seal of the present invention must involve the destructive separation of the flexible material segment at two spaced apart locations. One separation must occur at a location between the two lock rods thereby disengaging the intermediate portion from its wrapped orientation. However, one section of the flexible material segment extending between the lock body and the seal element still remains intact and will prevent opening of the latch assembly. Access to the interior of the cargo container will thereby still be denied. Therefore another destructive separation of the flexible material segment along the length between the lock body and seal element must also be made.

Further structural features of the improved cargo seal assembly of the present invention includes the provision of an identifying indicia placed preferably on the seal element. In practice, the identifying code is recorded and serves to identify the cargo container with which the improved cargo seal assembly of the present invention is utilized. As a practical matter, when using a conventional seal assembly only the primary seal element associated with the right hand door of the cargo container is periodically checked. As a result, only the identifying indicia or code associated with this primary seal element is reviewed in an effort to assure the tampering with the latch assembly and/or access to the interior of the cargo container has not been attempted or achieved.

Accordingly, the preferred embodiments of the improved cargo seal assembly of the present invention comprises only a single identifying indicia or code, thereby reducing the administrative procedures associated with recording and examining the authenticity of the cargo seal assembly. As set forth above, any attempt to defeat the subject cargo seal assembly would require a removal of the seal element and the performance of two destructive separations of the flexible material segment. The absence of the identifying indicia and/or the seal element itself will provide clear proof that tampering has occurred. Without the seal element and the identifying indicia the container will be prevented from being transferred between carriers and a determination as to when unauthorized access or tampering has occurred is thereby facilitated.

These and other objects, features and advantages of the present invention will become more clear when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

DETAILED DESCRIPTION OF THE PREFERRED EMBODIMENT

As shown in the accompanying drawings, the present invention is directed to a cargo seal assembly, generally indicated as 10, of the type intended to seal and lock a cargo container generally indicated as 12. As conventionally structured, the cargo container 12 includes one or more doors 14 and 16 pivotally mounted by a plurality of hinge structures 18 in covering relation to an access opening normally found at one end of the elongated cargo container 12.

Figure 1:
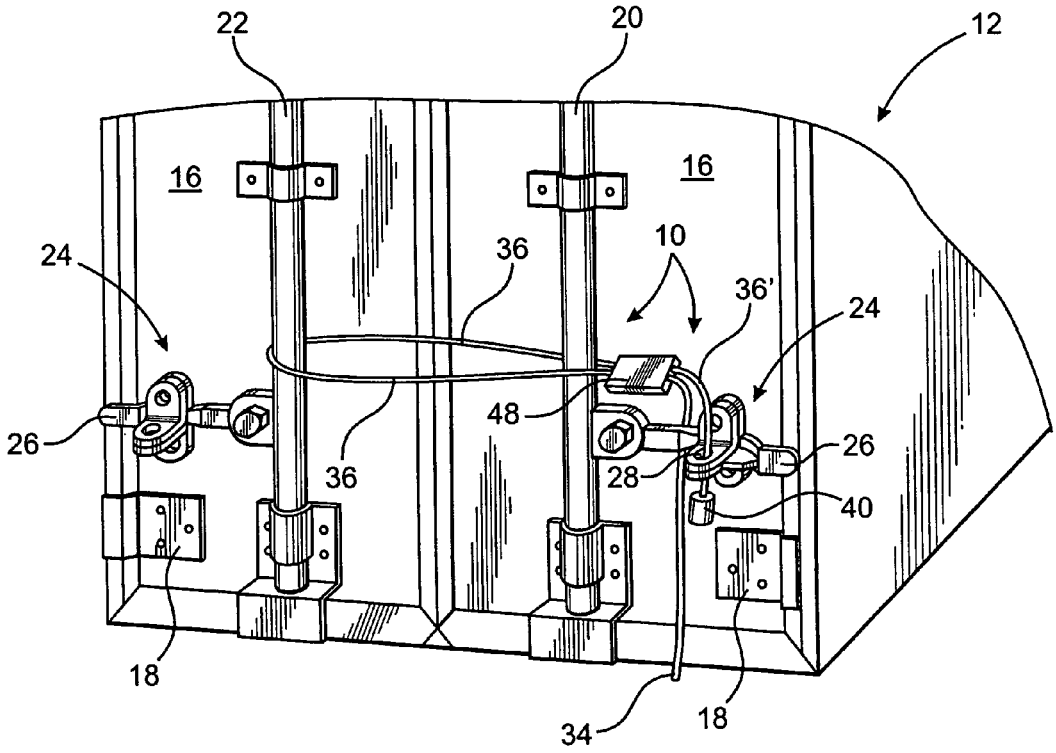
FIG. 1 is a perspective view in partial cutaway of a preferred embodiment of an improved cargo seal assembly of the present invention as applied to a cargo carrier and the locking and sealing structures associated therewith.

The locking assembly generally associated with conventional cargo containers 12 includes two spaced apart, vertical lock rods 20 and 22 which are secured to the respective doors 14 and 16 and selectively positioned between a locked orientation, as represented in FIG. 1 and an unlocked orientation, not shown for purposes of clarity. Each of the lock rods 20 and 22 comprises a latch assembly generally indicated as 24. Each of the latch assemblies 24 is cooperatively disposed and structured orientation as also shown in FIG. 1. Further, each of the latch assemblies 24 includes a seal aperture 28 formed in at least one part thereof and disposed and structured to receive some type of seal device or fixture therein. When the aforementioned seal device passes through the seal aperture 28 the latch assembly 24 is prevented from opening without removal or destruction of such a seal device. Accordingly, the respective lock rods 20 and 22 are secured in their closed and locked position until such a seal device is removed from the seal aperture 28.

While numerous types of seal and/or locking assemblies structured to be used with a latch assembly 24 and respective lock rods 20 and 22 are known, the cargo seal assembly 10 of the present invention is structured to provide a simplified mechanism which assures the security of the cargo maintained within a cargo carrier 12 unless destructively removed from its operative position of FIG. 1. In addition, the cargo seal assembly of the present invention is further structured to provide clear evidence of tampering upon inspection thereof, while also substantially identifying when tampering has occurred.

More specifically, the cargo seal assembly 10 of the present invention comprises an elongated flexible material segment generally indicated as 30. The segment 30 includes a proximal end 32 and a spaced apart distal end 34 connected by an intermediate portion 36. In at least one preferred embodiment, the flexible material segment 30 is formed from a high strength metallic or other material which is resistant to cutting, severing or other means of separating it along its length. As explained hereinafter, destructive separation of the flexible material segment 30, in at least two separate locations, is necessary to defeat the cargo seal assembly 10 when in its operative position in FIG. 1. When utilizing such metallic or other high strength material, common means to separate the flexible material segment 30 include bolt or cable cutters, an acetylene torch, etc. Moreover, such a high strength material is utilized to form the flexible material segment when maximum security is required to protect the cargo within the interior of the cargo container 12. It is of course important that any attempted tampering or theft be thwarted by making it as difficult as possible to provide unauthorized access to the interior of the cargo container 12, when maximum security is required.

Another preferred embodiment of the present invention comprises the flexible material segment 30 being formed of a plastic or other material of lesser strength. Such lesser strength material will of course be easier to destruct by cutting, severing, etc. However, such an embodiment would be considerably less expensive while still providing an acceptable degree of security under certain practical situations. As such, a plastic or other lesser strength material can be used to form the flexible material segment 30 such as when the cargo container 12 is being shipped empty or absent any meaningful or valued cargo contained on the interior thereof.

Figure 2:
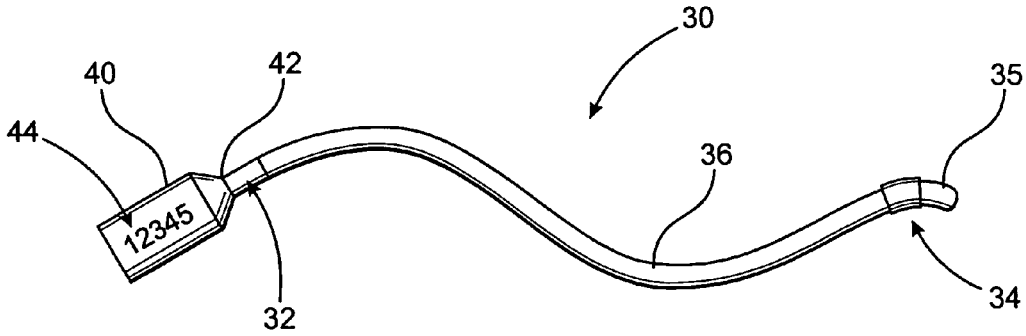
FIG. 2 is a perspective view of a flexible material segment associated with the preferred embodiment of the improved cargo seal assembly as disclosed in FIG. 1.

Yet another feature of at least one preferred embodiment of the present invention is the provision of a seal element 40 connected to the proximal end 42 in the manner clearly demonstrated in FIG. 2. The seal element 40 may be fixedly and/or permanently secured to the proximal end 32 of the flexible material segment 30 and made available to users as pictured in FIG. 2. Alternatively the flexible material segment 30 and the seal element 40 may be made available to users individually, by being initially separated from one another. In this latter embodiment the proximal end 32 may be specifically structured to be received within an opening or receiving area as at 42 of the seal element 40 in a manner which prevents or restricts the removal therefrom once the seal element 40 is connected to the flexible material segment in the manner shown in FIG. 2. Cooperative structuring of one or both of the ends 32 and 34 may comprise a "bullet tipped" member as at 35 being swaged onto the one or more ends 32 and 34.

Other features associated with the seal element 40 include the provision of informational indicia 44 in the form of a coded alpha/numeric array. This informational indicia is used to identify a particular cargo carrier 12. When the flexible material segment 30 is disposed in its operative position of FIG. 1 the recording of the informative indicia or code 44 will be part of the normal administrative processing serving to indicate that a specific flexible material segment 30 and seal element 40 has been used to seal and lock a given cargo container 12. During transit, the informative indicia/code 44 will be periodically checked to assure that the flexible material element 30 and/or seal element 40 has not been replaced, such as by an unauthorized personnel who have acquired access to the interior of the cargo container 12. Naturally, the presence of a flexible material segment 30 and/or a seal element 40 absent the previously recorded informative indicia/code 44 will provide clear evidence of tampering or unauthorized access and a general time period when such tampering has occurred.

Figure 3:
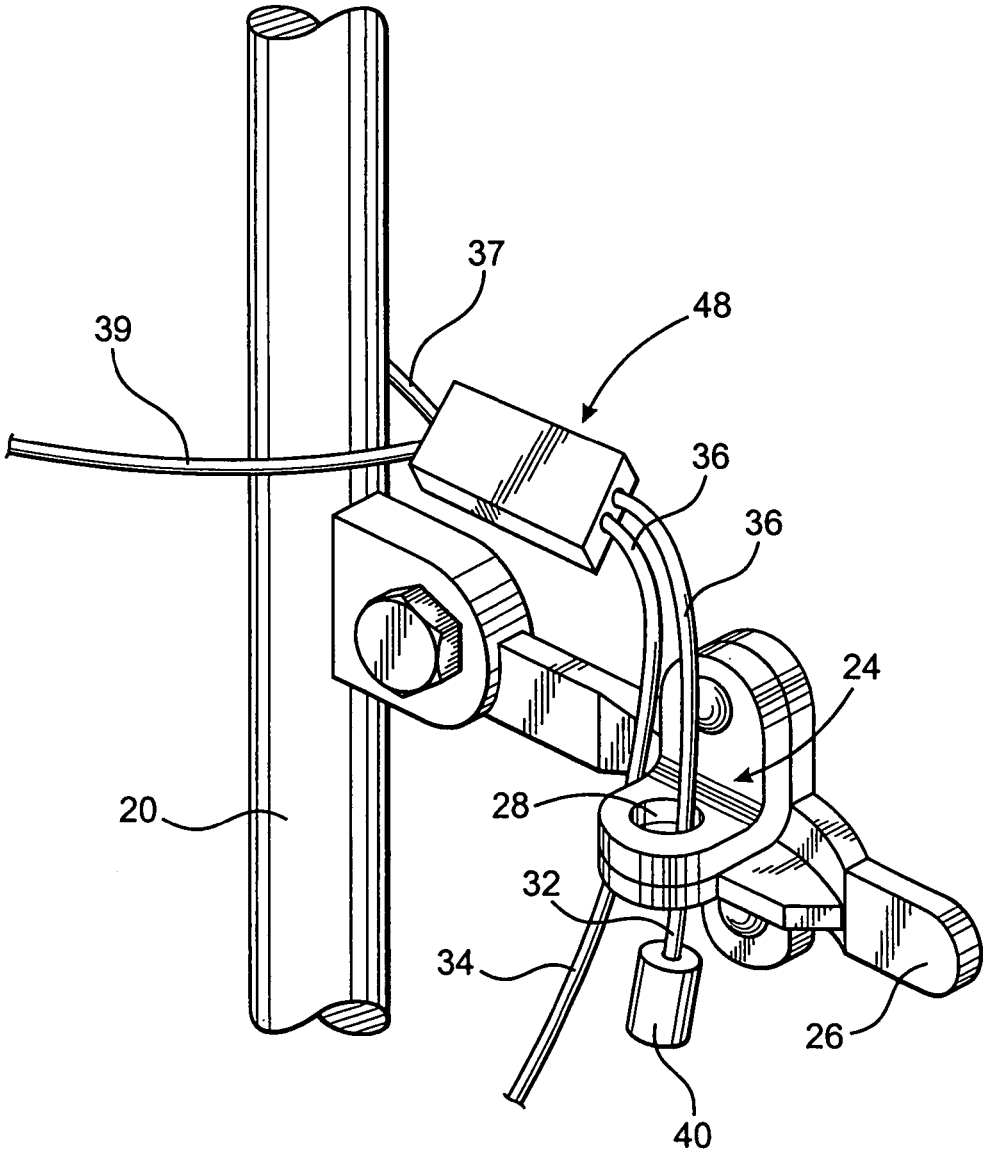
FIG. 3 is a perspective view in detail and partial cutaway disclosing operative positioning of the various components of the embodiment of FIG. 1 of the present invention.

Another feature of the cargo seal assembly 10 of the present invention is the structure and dimension of the seal element 40 relative to the distal end 34 and at least the majority of the length of the intermediate portion 36 or the entire length thereof. As disclosed, the seal element 40 is enlarged, at least to the extent of having a greater width, diameter or overall transverse dimension than the diameter, transverse dimension, etc. of the ends 32 and 34 and intermediate portion 36. Moreover, the dimension and structuring of the ends 32 and 34 and the intermediate portion 36 is such as to allow the free passage thereof through the seal aperture 28 associated with the latch assembly 24. Accordingly, the disposition of the flexible material member 30 in the sealing and locking position as shown in FIGS. 1 and 3, involves a length of the intermediate portion being positioned in surrounding relation to the lock rods 20 and 22 and into what may be referred to as a "wrapped orientation". Once disposed in the wrapped orientation, a lock body generally indicated as 48 is secured to adjacently oriented portions 37 and 39 of the flexible material segment 30. Thereafter one free end of the flexible material member 30, such as the proximal end 32, is passed through the seal aperture 28 and secured to the enlarged primary seal element 40.

As set forth above, the seal element 40 may be secured to one end 32 of the flexible material segment 30 prior to the flexible material member 30 being secured on its locked and sealed position of FIG. 1. In such an embodiment, the distal end 34 is initially threaded through the seal aperture 28. The intermediate portion is also passed therethrough until the enlarged seal element 40, previously affixed to the proximal end 32 is disposed in abutting and/or at least substantially adjacent relation to the latch assembly 24 as represented in FIG. 3.

The lock body 48 may take a variety of different structural configurations each of which provide a secure and permanent anchoring or attachment of the adjacently oriented portions 37 and 39 of the intermediate portion 36 of the flexible material segment 30 as best shown in FIG. 3. When the lock body 48 is disposed in its secured, operative position, the intermediate portion 36 is maintained in the aforementioned wrapped orientation. Moreover, the wrapped orientation of the intermediate portion 36 may be more precisely defined as a tightly engaging and surrounding relation of intermediate portion 36 about both of the lock rods 20 and 22 thereby restricting separation of the lock rods 20 and 22 such as when the doors 14 and 16 are attempted to be opened. Accordingly, the "tight wrapped" positioning of the intermediate segment 36, when in its wrapped orientation of FIG. 1, may provide at least some minimal separation of the lock rods 20 and 22. However, the wrapped orientation of the intermediate portion 36 should be sufficiently "tight" to prevent the opening or separation of doors 14 and 16 an amount sufficient to allow access to the interior of the cargo container 12. Once the lock body 48 is disposed in its secured position shown in FIGS. 1 and 2, the remainder of the length of the flexible material segment extending between the distal end 34 and the lock body 48 may be disposed in any convenient location as it extends outwardly from the lock body 48.

In addition to best maintain the intermediate portion 36 in the wrapped orientation, the lock body 48 is disposed exteriorly of the lock rods 20 and 22 and preferably immediately adjacent and exterior surface of one of such lock rods as at 20. Also, while the distance between the lock body 48 and the seal aperture 28 will be substantially the same, once the lock body 48 in its operative position, the length of the flexible material segment 30 extending between the lock body 48 and the seal element 40, may vary in dimension depending upon the particular structure and overall configuration of the latch assembly 24 and lock rods 20 and 22. As such, the length of the section 36' of the intermediate portion 36 may be such as to allow disposal or positioning of the seal element 40 out of immediate abutting relation to the latch assembly 24 but in a position which maintains some portion of the section 36' of the flexible material segment 30 within the seal aperture 28.

Removal of the flexible material segment 30 from its operative, sealing and locking position of FIGS. 1 and 3 will thereby require at least two destructive separations of the flexible material segment 30 along its length. One such separation must occur at some point along the intermediate portion 36, between the lock rods 20 and 22 (or immediately adjacent thereto). Another severing, cutting or like separation of the intermediate segment 36 must occur at some point along the section 36' between the lock body 48 and seal element 40 in order to remove the section 36' from the seal aperture 28. As emphasized above the seal element 40 has enlarged transverse dimension which prevents its passage through the seal aperture 28. Similarly, the lock body 48 also includes a sufficiently large dimension to prevent its passage through the seal aperture 28. Therefore, the removal of section 36' from the seal aperture 28 can only be accomplished by a destructive separation of the section 36' between the lock body 48 and the seal element 40.

Figure 4:
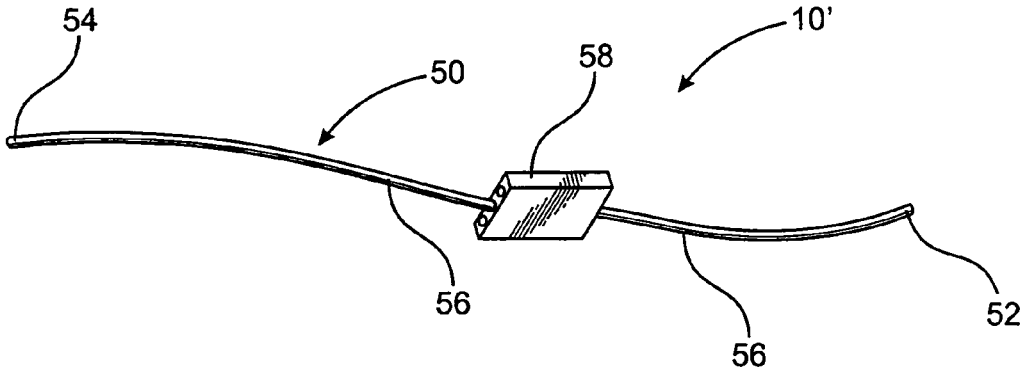
FIG. 4 is a perspective view of yet another preferred embodiment of the cargo seal assembly of the present invention.
Figure 5:
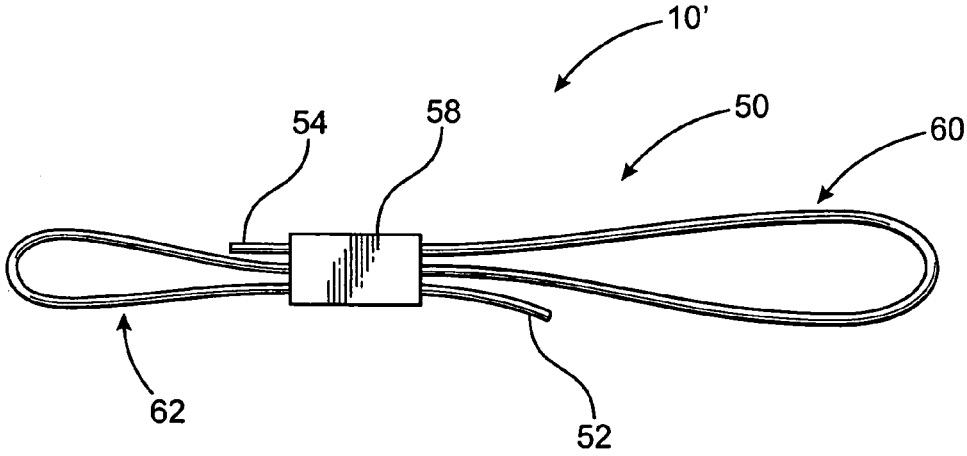
FIG. 5 is a perspective view in schematic form of the embodiment of FIG. 4 disposed in an operative position absent the locking and sealing assemblies associated with a conventional cargo container.
Figure 5A:
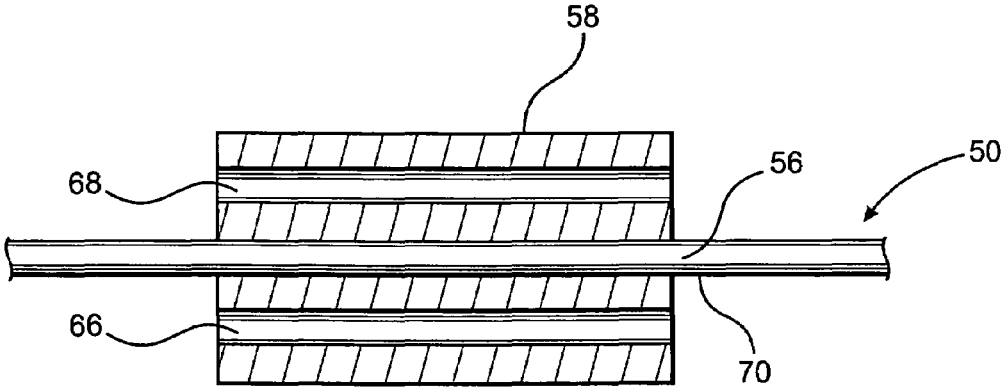
FIG. 5A is a detailed sectional view in partial cutaway of a modification of the embodiment of FIG. 4.
Figure 5B:
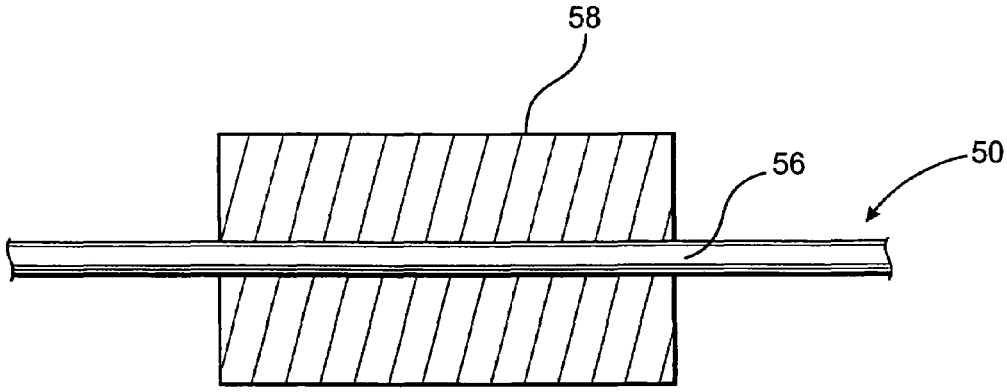
FIG. 5B is a detailed view in partial cutaway similar to but structurally distinguishable from the embodiment of FIG. 5B.
Figure 6:
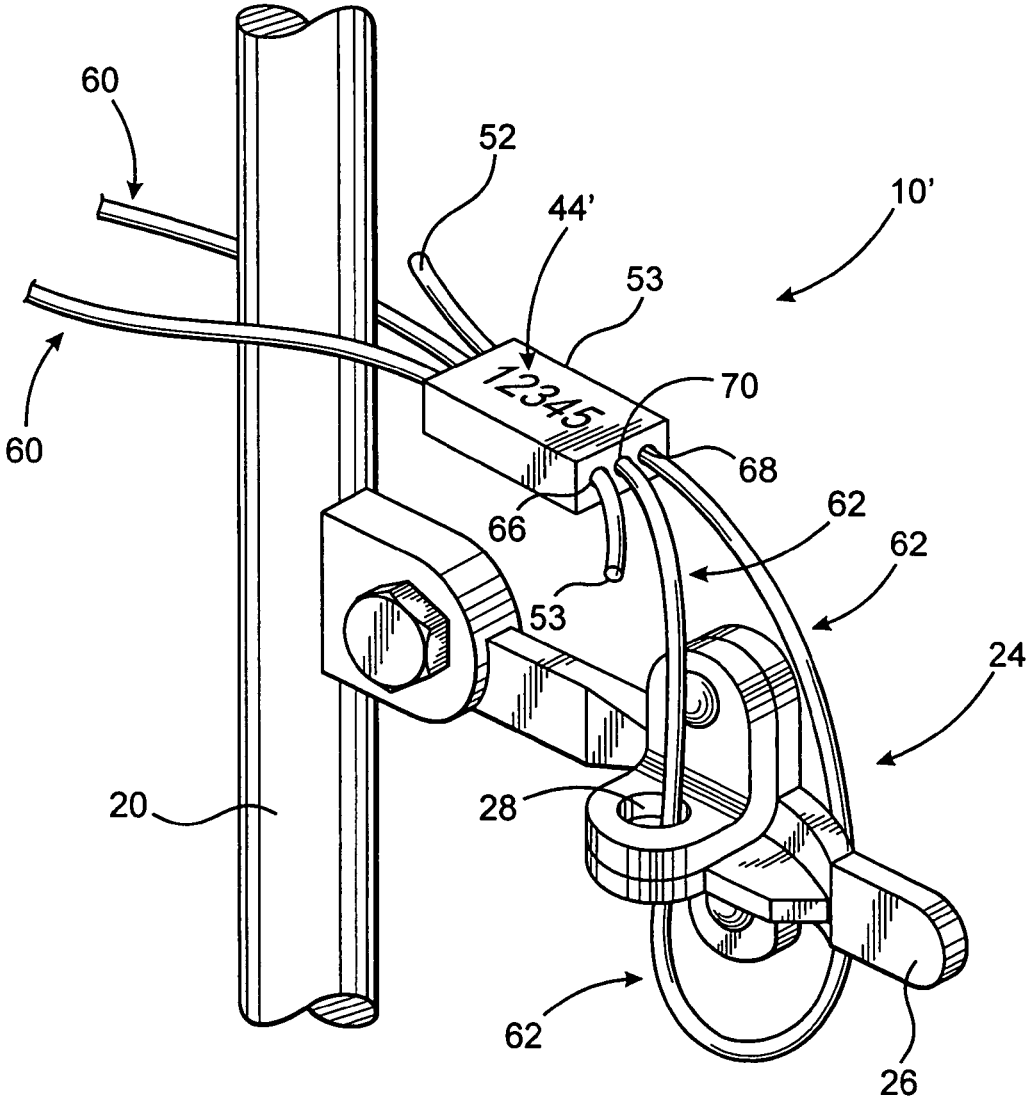
FIG. 6 is a detailed view in partial cutaway disclosing the preferred embodiment of FIGS. 4 and 5 in an operative position relative to a lock rod and latch assembly of a conventional cargo container on which the subject invention may be utilized.

Another embodiment of the improved cargo seal assembly is generally indicated as 10' and is disclosed in detail in FIGS. 4 through 6. More specifically, this embodiment comprises an elongated flexible material segment 50 including a proximal end 52, a distal end 54 and an intermediate portion 56 extending therebetween. A lock body 58 functionally similar but structurally distinguishable from the lock body 48 of the embodiments of FIGS. 1 through 3 is fixedly secured to intermediate portion 56 in spaced relation to both the proximal end 52 and the distal end 54. As will be described in greater detailed with reference to FIGS. 5A and 5B, the intermediate portion 56 may be permanently secured to the lock body 58 as by passing through and being swaged within one of a plurality of passages or channels, as at 70 in FIG. 5A, formed within and extending through the lock body 58 as also clearly shown in FIG. 6. However, at least one preferred embodiment of the present invention contemplates other means of fixedly or permanently securing the intermediate portion 56 of the flexible material segment 50 to the lock body 58, such as by being integrally formed thereon or by being fixedly or integrally secured to the exterior of the lock body 58 as represented in FIG. 5B.

As should be apparent from a review of FIG. 6, the improved cargo seal assembly 10' functions generally similarly to the embodiment of the cargo seal assembly 10 as disclosed in FIGS. 1 through 3. As such, the flexible material segment 50 is disposed in surrounding relation to both the vertical lock rods 20 and 22 and into the aforementioned wrapped orientation. In addition, a portion of the flexible material segment 50 is connected in sealing engagement to the latch structure 24 so as to prevent opening thereof and manipulation of the latch handle 26 to the extent of disposing the lock rod 20 in an open or unlocked orientation, as described above. Clearly, one distinguishing feature of this preferred embodiment of the cargo seal assembly 10' is the absence of a seal element 40, which is an operative components of the embodiment of FIGS. 1 through 3.

FIG. 4 is representative of the cargo seal assembly 10' as it is made available to the user. As such, the lock body 58 may be assembled in its intended position on the intermediate portion 56 between the opposite ends 52 and 54 thereof. FIG. 5 is a schematic representation of the flexible material segment 50 in what may be considered an operative position, such as when it is disposed to both lock and seal a cargo container 12 in a manner which locks the lock rod 20 and 22 and seals the latch assembly 24. More specifically, in such an operative position a first section 60 of the intermediate portion 50 is formed into a substantially closed loop which surrounds the lock rods 20 and 22 and thereby defines the aforementioned wrapped orientation. In order to maintain the closed loop configuration of FIGS. 5 and 6, the distal end 54 passes back through the lock body 58.

Similarly, when in its preferred, operative orientation, the flexible material segment 50 comprises a second section generally indicated as 62, which is also formed into a substantially closed loop configuration by passing the proximal end 52 back through the lock body 58. When so disposed, the second section 62 is formed by passing the proximal end 52 through the seal aperture 28 of the latch structure 24 and then back through the lock body 58. Accordingly, the second section 62 of the flexible material segment 50 is disposed in sealing connection and/or engagement with the latch structure 24 by maintaining its position within the seal aperture 28. Therefore, the cargo seal assembly 10' maintains a seal connection of the latch structure 28 absent the provision of the seal element 40 as described with reference to the embodiment of FIGS. 1 through 3.

Structural features of the lock body 58 comprise the plurality of passages or channels as set forth above. As best shown in FIG. 6, such plurality of passages include at least a first passage 66 extending completely through the lock body 58 and being opened at opposite ends thereof. The first passage 66 is designed to facilitate passage of the distal end 54 therethrough once the first section 60 is disposed in a locked position, defined by a wrapped orientation about the lock rods 20 and 22. Similarly, the plurality of passages of the lock body 58 include a second passage 68 extending completely through the lock body 58 and being open at opposite ends. The second passage 68 facilitates the passing of the proximal end 52 therethrough once in the sealing position of the second section 62 has been achieved by passing a portion of the length of the second section through the seal aperture 28.

Finally, the plurality of passages of the lock body 58 include a third passage 70 through which the flexible material segment 50 passes in order to permanently or fixedly secure the lock body 58 to the intermediate portion 56 between opposite ends 52 and 54 as disclosed and described with reference to FIGS. 4 and 5. It should be apparent that once the first and second section 60 and 62 are in their respective locking position and sealing position, the improved cargo seal assembly 10' can not be removed from the cargo container 12 without destructive separation of the flexible material segment 50 at two separate, spaced apart locations. As set forth above with regard to the embodiment of FIG. 3 one such destructive separation occurs between or immediately adjacent to the lock rods 20 and 22. Another separation must also occur between the lock body 58 and the latch structure 24.

Therefore maintaining the lock body 58 in a permanently fixed position relative to the intermediate portion 56 and the first and second section 60 and 62 respectively is necessary to maintain security of the cargo container 12. As such, the lock body 58 includes a locking assembly. The locking assembly may include any of a variety of locking mechanisms which allow the passage of the respective proximal and distal end 52 and 54 through the passages 68 and 66 in one direction and thereafter prevents their removal from the lock body once the lock body is disposed in its operative location as depicted in FIG. 6. Locking mechanisms associated with each of the passages 66, 68 and perhaps passage 70 could take a variety of configurations.

Yet additional features associated with the lock body 58 is the provision of informative indicia 44' provided for purposes of recording and administrative processing of the identity of the cargo container 12, as described above with reference to the informative indicia or code 44 disposed on the seal element as disclosed in the embodiment of FIG. 2.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. In combination with a cargo container including at least one door, a pair of spaced apart lock rods structured to maintain the door in a closed orientation and a latch structure having a seal aperture and structured to latch the door in a closed orientation, a cargo seal assembly comprising:

a) an elongate, flexible material segment including a proximal end, a distal end and an intermediate portion;

b) a lock body fixedly secured to said intermediate portion in spaced relation to both said proximal and distal ends, c) said flexible material segment including a first section and a second section respectively disposed in a locking position and a sealing position, d) said locking position comprising said first section disposed in a wrapped orientation concurrently about both the lock rods and said sealing position comprising said second section extending through the sealing aperture of the latch assembly in sealing relation to said latch structure, and e) said lock body disposed and structured to secure said first section and said second section in said locking position and said sealing position respectively.

2. A cargo seal assembly as recited in claim 1 wherein said first section comprises a length of said intermediate portion between said lock body and said distal end having a sufficient longitudinal dimension to surround both of the lock rods.

3. A cargo seal assembly as recited in claim 2 wherein said first section comprises a substantially closed loop configuration when in said locking position.

4. A cargo seal assembly as recited in claim 3 wherein said second section comprises a length of said intermediate portion having a sufficient longitudinal dimension to extend outwardly from said lock body and through the seal aperture in sealing relation to the latch structure.

5. A cargo seal assembly as recited in claim 4 wherein said second section comprises a substantially closed loop configuration when in said sealing position.

6. A cargo seal assembly as recited in claim 1 wherein said lock body is structured to receive said distal end and said proximal end therethrough while said first and second sections are being disposed in said locking and sealing position respectively.

7. A cargo seal assembly as recited in claim 6 wherein said lock body comprises at least a first passage and a second passage formed therein, each of said first and second passages disposed and structured to receive a different one of said proximal and distal ends therein, when said first and second sections are in said locking and sealing positions respectively.

8. A cargo seal assembly as recited in claim 7 wherein said lock body further comprises at least a third passage structured to receive and be secured to said intermediate portion.

9. In combination with a cargo container including at least one door, a pair of spaced apart locked rods structured to maintain the door in a closed orientation and a latch structure having a seal aperture and structured to latch the door in a closed orientation, a cargo seal assembly comprising:

a.) an elongate, flexible material segment including a proximal end, a distal end and an intermediate portion;

b.) a lock body secured to said intermediate portion in spaced relation to both said proximal and distal ends, c.) said flexible material segment including a first section and a second section each having a closed loop configuration disposed adjacent to and extending outwardly from said lock body, d.) said first section disposed in a locking position defined by a wrapped orientation about both of the lock rods, e.) said second section disposed in a sealing position at least partially defined by passage of said second section through the sealing aperture of the latch structure, and f.) said lock body disposed and structured to secure said first and second sections in said locking position and said sealing position respectively.

* * * * *